US006086439A

United States Patent [19]

Vasile

[11] Patent Number: 6,086,439

[45] Date of Patent: Jul. 11, 2000

[54] ADJUSTABLE DEPTH MARKER BUOY

[76] Inventor: Benedetto Vasile, 365 Klondike Ave., Staten Island, N.Y. 10314

[21] Appl. No.: 09/157,262

[22] Filed: Sep. 21, 1998

[51] Int. Cl.[7] ..... B63B 22/18

[52] U.S. Cl. ..... 441/25; 441/26; 441/28

[58] Field of Search ..... 73/305, 306, 315; 441/11, 21, 23, 24, 25, 26, 28; 33/719, 720

[56] References Cited

U.S. PATENT DOCUMENTS

| | | | |
|---|---|---|---|
| 3,653,085 | 4/1972 | Rovner | 9/8 |
| 4,077,076 | 3/1978 | Masters | 441/16 |
| 4,501,563 | 2/1985 | Johnson et al. | 441/6 |
| 4,778,422 | 10/1988 | Saulnier et al. | 441/26 |
| 4,781,636 | 11/1988 | Schurr | 441/6 |
| 4,808,133 | 2/1989 | Gram et al. | 441/6 |
| 5,087,216 | 2/1992 | Noggle | 441/6 |
| 5,256,093 | 10/1993 | Balstad | 441/6 |
| 5,449,308 | 9/1995 | Thompson | 441/6 |
| 5,947,780 | 9/1999 | Kellner et al. | 441/6 |

*Primary Examiner*—Sherman Basinger
*Attorney, Agent, or Firm*—Richard L. Miller

[57] ABSTRACT

An adjustable depth marker buoy for marking a spot beneath the surface of water. The buoy includes a float for floating on the surface of the water and a reel assembly disposed in the float. The bottom wall of the float has a weight depending therefrom that maintains an upright orientation for the buoy when it is in the water. The reel assembly includes a spool of anchor line, a non-threaded rod, a threaded rod, a nut assembly that threadably moves along the threaded rod and slidably along the non-threaded rod, and a pointer assembly that moves slidably along the non-threaded rod. When the spot is located, its depth is determined. The pointer assembly is then slide along the non-threaded rod, until its pointer points to depth scale indicia on the depth plate corresponding to the depth of the spot beneath the surface of the water. The anchor line is then wound out until the nut assembly contacts the pointer assembly forming a stop and indicating that the anchor line has been fed out a length equivalent to the depth of the spot beneath the surface of the water. At this point the spool assembly is prevented from further rotation by a lock pin. The buoy is then thrown into the water at the spot causing the anchor weight to engage the bottom of the water and thereby minimize drift of the adjustable depth marker buoy, by virtue of the anchor line having a length equivalent to the depth of the water.

39 Claims, 11 Drawing Sheets

ADJUSTABLE DEPTH MARKER BUOY

BACKGROUND OF THE INVENTION

1. Field of the Invention

The present invention relates to a marker buoy. More particularly, the present invention relates to an adjustable depth marker buoy.

2. Description of the Prior Art

Numerous innovations for marker buoys have been provided in the prior art that will be described. Even though these innovations may be suitable for the specific individual purposes to which they address, however, they differ from the present invention.

A FIRST EXAMPLE, U.S. Pat. No. 3,653,085 to Rovner teaches a self-setting marker device for fishermen and boatmen that has a buoyant somewhat elongate, symmetrical body provided with an axial substantially reduced medial portion constituting with adjacent larger portions a spool element upon which an anchoring line is attached and may be helically wound. A small heavy anchoring weight is attached to the outer end of the line and serves to by gravity pay out the line (with revolution of the body) when the device with would line is cast upon the water. Closely cooperating with said components is a bias-weight medium secured to said body in a position of balance relative to the body length, but disposed widely eccentric of the axis of said body to restrain revolution of said body during the torque effect of said line and anchor weight; and effective to positively stop further pay off of line when the anchor weight rests upon the bottom of a water way. Then the requisite length of anchor line is measured and set for various depths each time the wound device is cast, and further pay off of line and driftage of the body is prevented in spite of usual winds and water currents.

A SECOND EXAMPLE, U.S. Pat. No. 4,501,563 to Johnson et al. teaches a marker buoy useful to indicate the location of an underwater structure. The buoy is made from a material having a density less than water, including first and second elongated side members and a central portion therebetween. The central portion received an elongated twine having a weight attached to its far end. Each side member has a stud extending away therefrom at opposing ends of the buoy. The buoy automatically rotates to dispense the twine when the buoy is placed on the surface of water, and is adapted to be manually rotated by manipulation of the studs to retract the twine.

A THIRD EXAMPLE, U.S. Pat. No. 4,781,636 to Schurr teaches a portable marine marker buoy having a transparent signal support housing which is carried by a float and is stabilized in the water by a depending weight assembly and which is restrained from drifting by an anchor which is deployed by an automatically locking anchor line dispensing reel assembly.

A FOURTH EXAMPLE, U.S. Pat. No. 4,808,133 to Gram et al. teaches an anchor locating buoy system with a self-retracting anchor line. The buoy system automatically collects and stores any excess portion of line between a marker float and an anchor thereby minimizing the distance between the marker float and the anchor.

A FIFTH EXAMPLE, U.S. Pat. No. 5,087,216 to Noggle teaches a marker buoy adapted to be held in the hand and thrown on the surface of a body of water to mark a location beneath the surface that comprises a thin, hollow, water-tight box with a concentric aperture through the thickness dimension of the box. The box is constructed of upper and lower concave shells which are mirror symmetric through the medial transverse plane of the box, where the two shells are bonded to one another. Recesses formed between internal walls within the shells hold a reel assembly have a take-up spool located in the aperture, and a crankshaft fitted with a handle protruding through a side of the box. A flexible cord is attached to the take-up spool and wound around the spool by turning the crankshaft handle. The other end of the cord is attached to an anchor weight.

A SIXTH EXAMPLE, U.S. Pat. No. 5,449,308 to Thompson teaches a pair of buoy winding apparatus that includes a housing having a pair of opposite end portions and a central cavity defined therein between the opposite end portions and being open at a side thereof for receiving a marker buoy therein, a support shaft mounted to one opposite end portion of the housing and having an end protruding into one end of the central cavity, the end of the support shaft being adapted to rotatably engage one end of the marker buoy so as to rotatably support the one end of the marker buoy, and a drive motor mounted to the other of the opposite end portions of the housing and having an output drive shaft extending therefrom with an end protruding into an opposite end of the central cavity, the end of the output drive shaft being adapted to non-rotatably engage an opposite end of the marker buoy so as to rotatably drive the marker buoy, in response to actuation of operation of the drive motor, about a rotational axis defined by and between the support and drive shafts and extending between the opposite end portions of the housing. The marker buoy is improved by having a pair of detent elements disposed in respective enlarged opposite ends being adapted to respectively rotatably support and drivingly couple the marker buy within the winding apparatus.

It is apparent that numerous innovations for marker buoys have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide an adjustable depth marker buoy that avoids the disadvantages of the prior art.

ANOTHER OBJECT of the present invention is to provide an adjustable depth marker buoy that is simple and inexpensive to manufacture.

STILL ANOTHER OBJECT of the present invention is to provide an adjustable depth marker buoy that is simple to use.

BRIEFLY STATED, YET ANOTHER OBJECT of the present invention is to provide an adjustable depth marker buoy for marking a spot beneath the surface of water. The buoy includes a float for floating on the surface of the water and a reel assembly disposed in the float. The bottom wall of the float has a weight depending therefrom that maintains an upright orientation for the buoy when it is in the water. The reel assembly includes a spool of anchor line, a non-threaded rod, a threaded rod, a nut assembly that threadably moves along the threaded rod and slidably along the non-threaded rod, and a pointer assembly that moves slidably along the non-threaded rod. When the spot is located, its depth is determined. The pointer assembly is then slide along the non-threaded rod, until its pointer points to depth scale indicia on the depth plate corresponding to the depth of the spot beneath the surface of the water. The anchor line is then wound out until the nut assembly contacts the pointer assembly forming a stop and indicating that the anchor line has been fed out a length equivalent to the depth of the spot beneath the surface of the water. At this point the spool assembly is prevented from further rotation by a lock pin. The buoy is then thrown into the water at the spot causing the anchor weight to engage the bottom of the water and thereby minimize drift of the adjustable depth marker buoy, by virtue of the anchor line having a length equivalent to the depth of the water.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
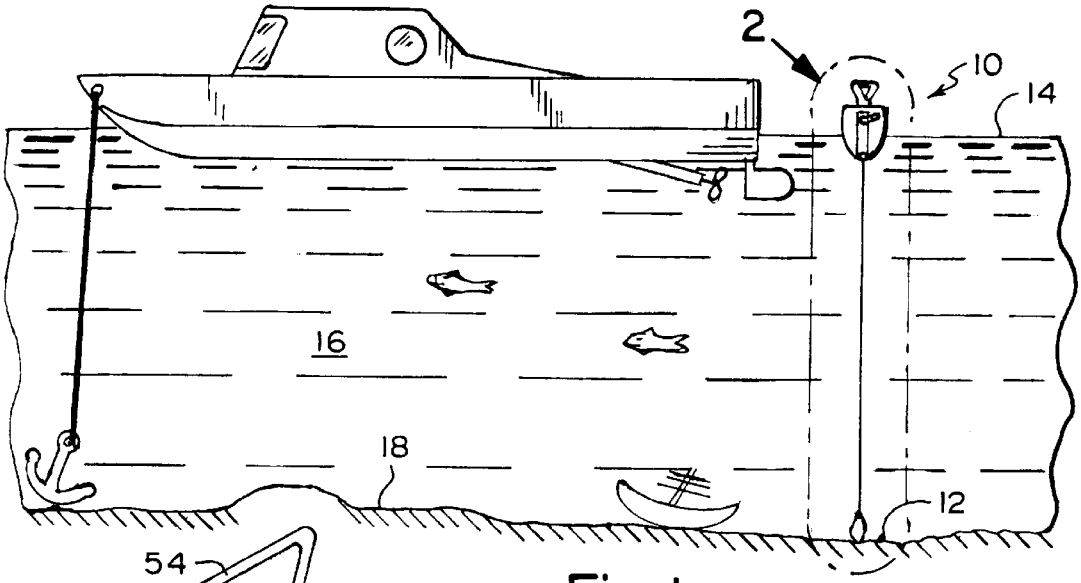
FIG. 1 is a diagrammatic side elevational view of the present invention marking a fishing spot.
Figure 2:
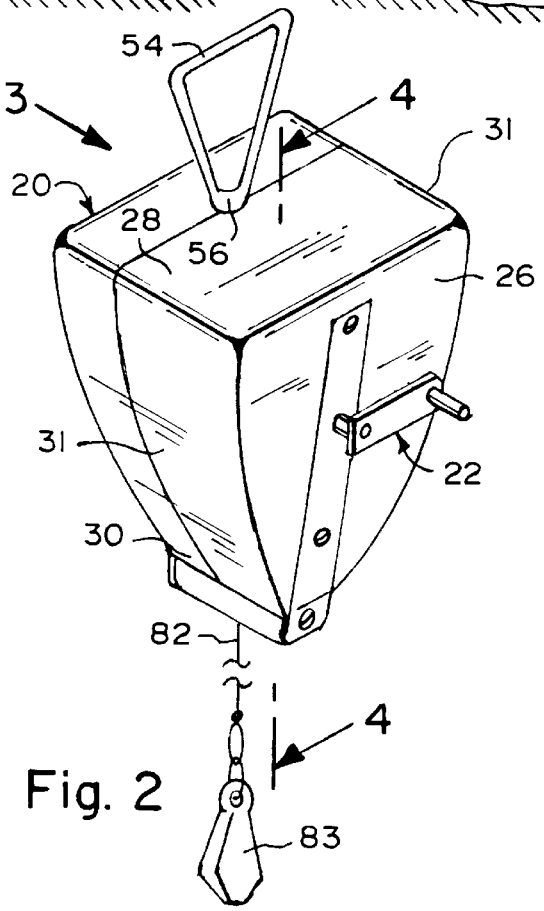
FIG. 2 is an enlarged diagrammatic perspective view of the area generally enclosed by the dotted ellipse identified by arrow 2 in FIG. 1 of the present invention.
Figure 3:
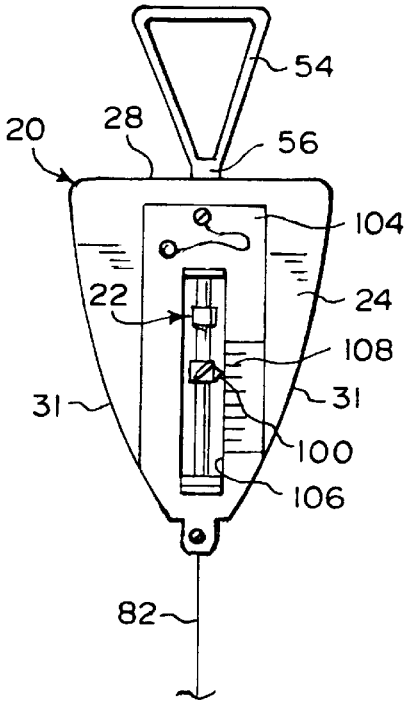
FIG. 3 is a reduced diagrammatic side elevational view taken generally in the direction of arrow 3 in FIG. 2 of the present invention.
Figure 4:
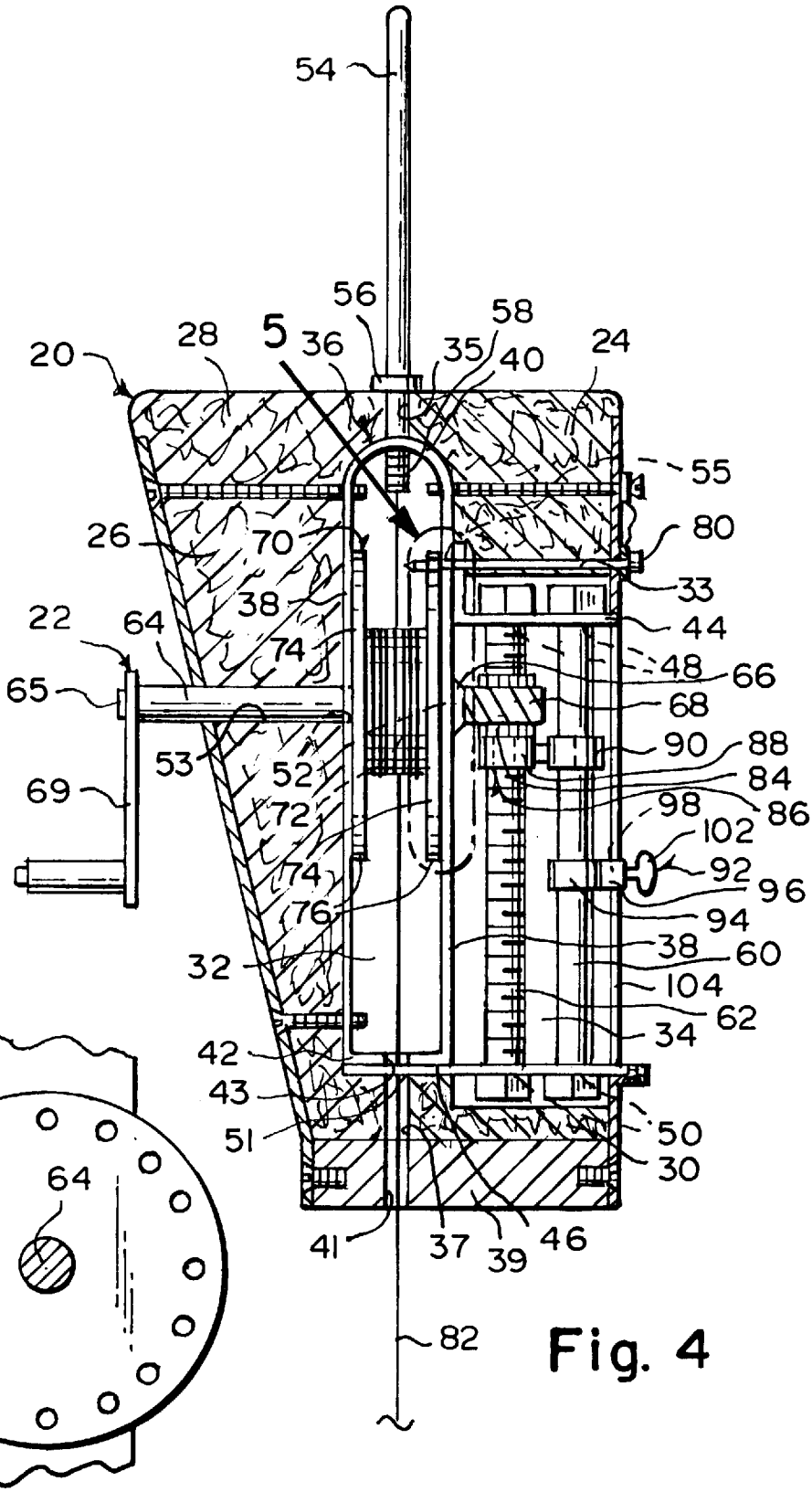
FIG. 4 is an enlarged cross sectional view taken on line 4—4 in FIG. 2.
Figure 5:
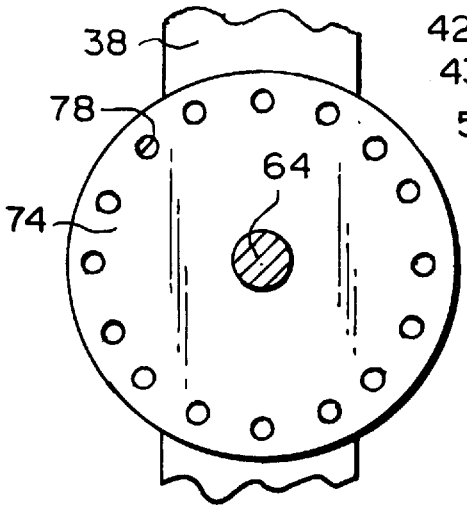
FIG. 5 is an enlarged diagrammatic side elevational view of the area generally enclosed by the dotted ellipse identified by arrow 5 in FIG. 4.
Figure 6A:
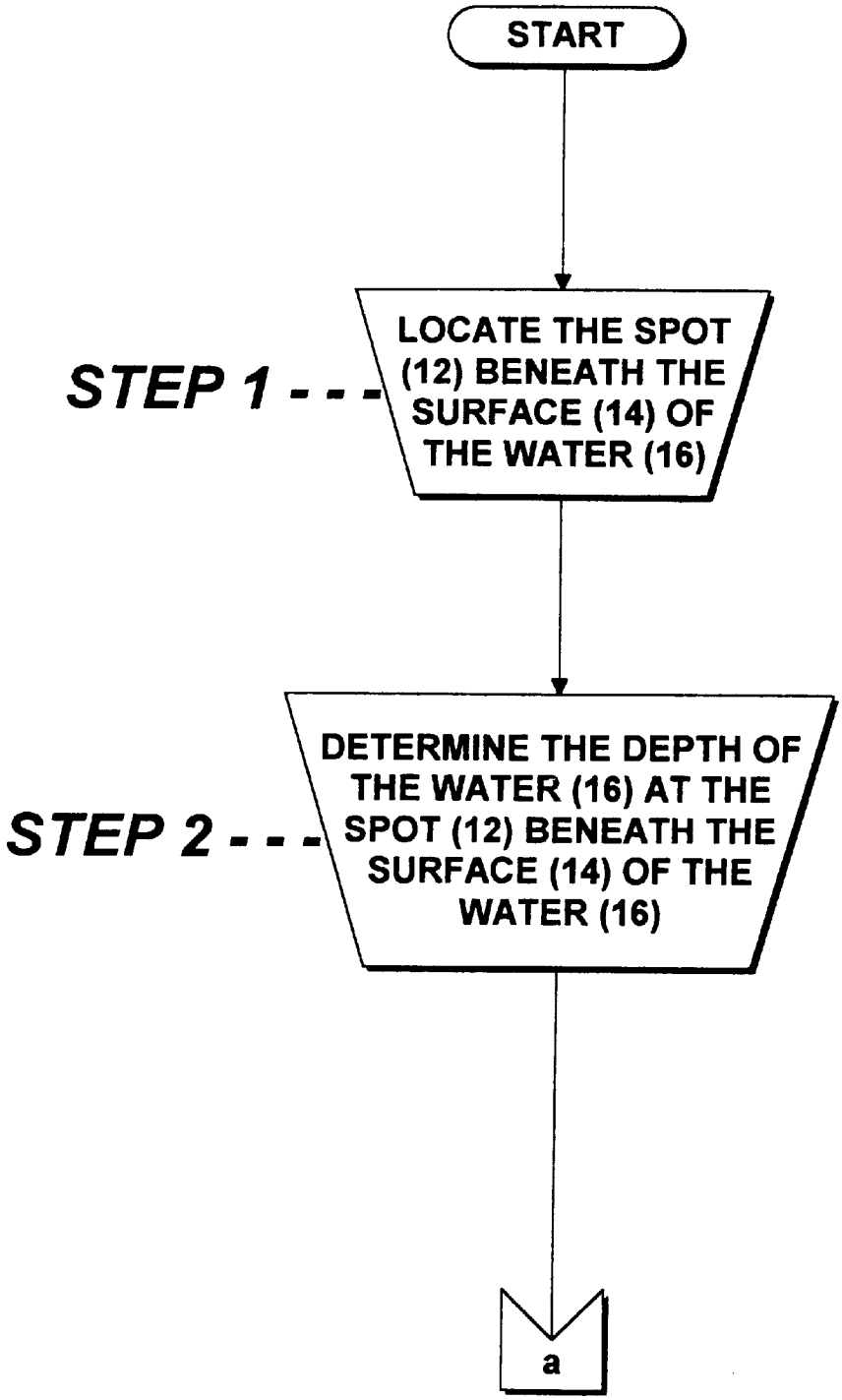
FIGS. 6A–6I are a process flow chart for utilizing the present invention.
Figure 6B:
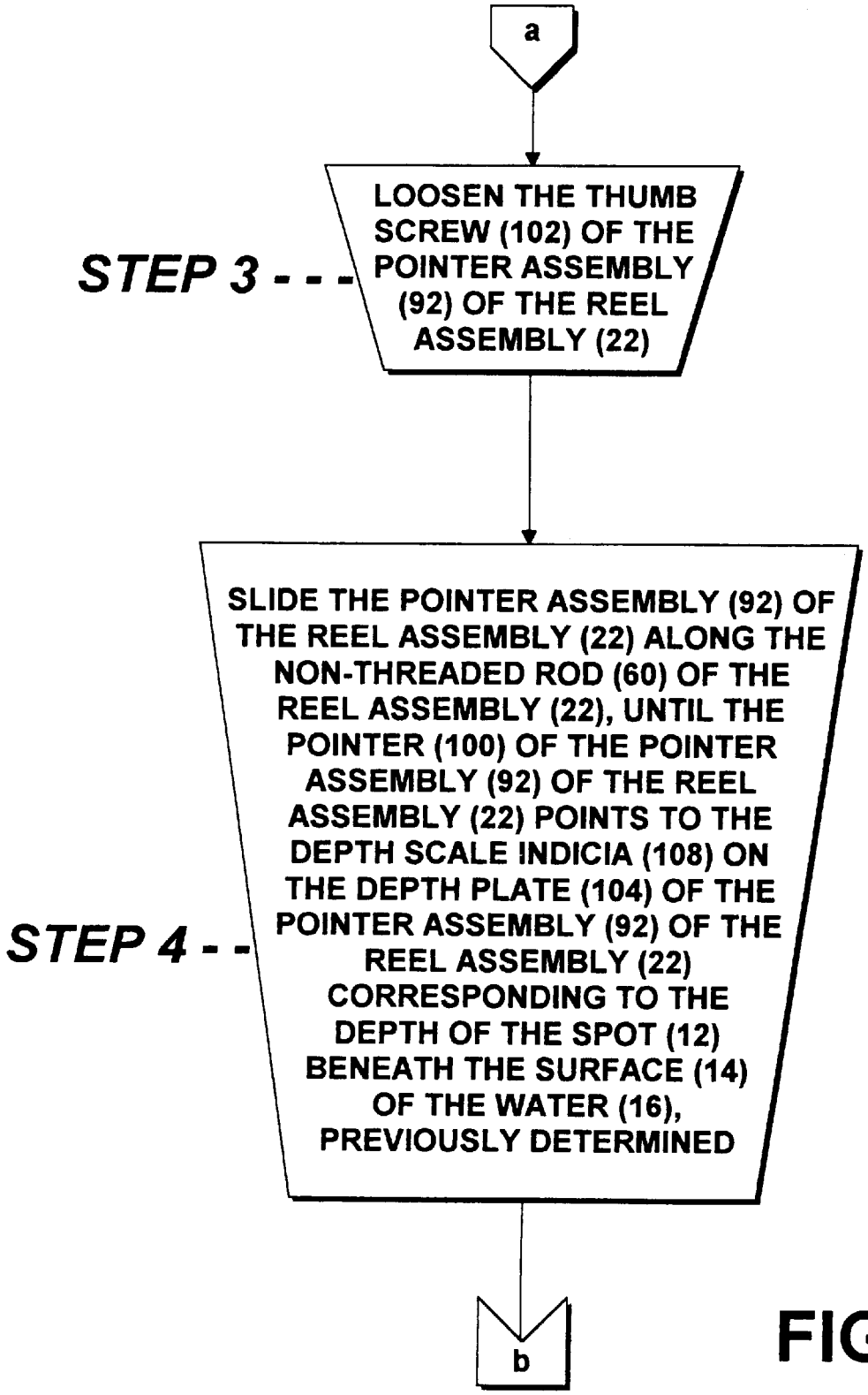
Figure 6C:
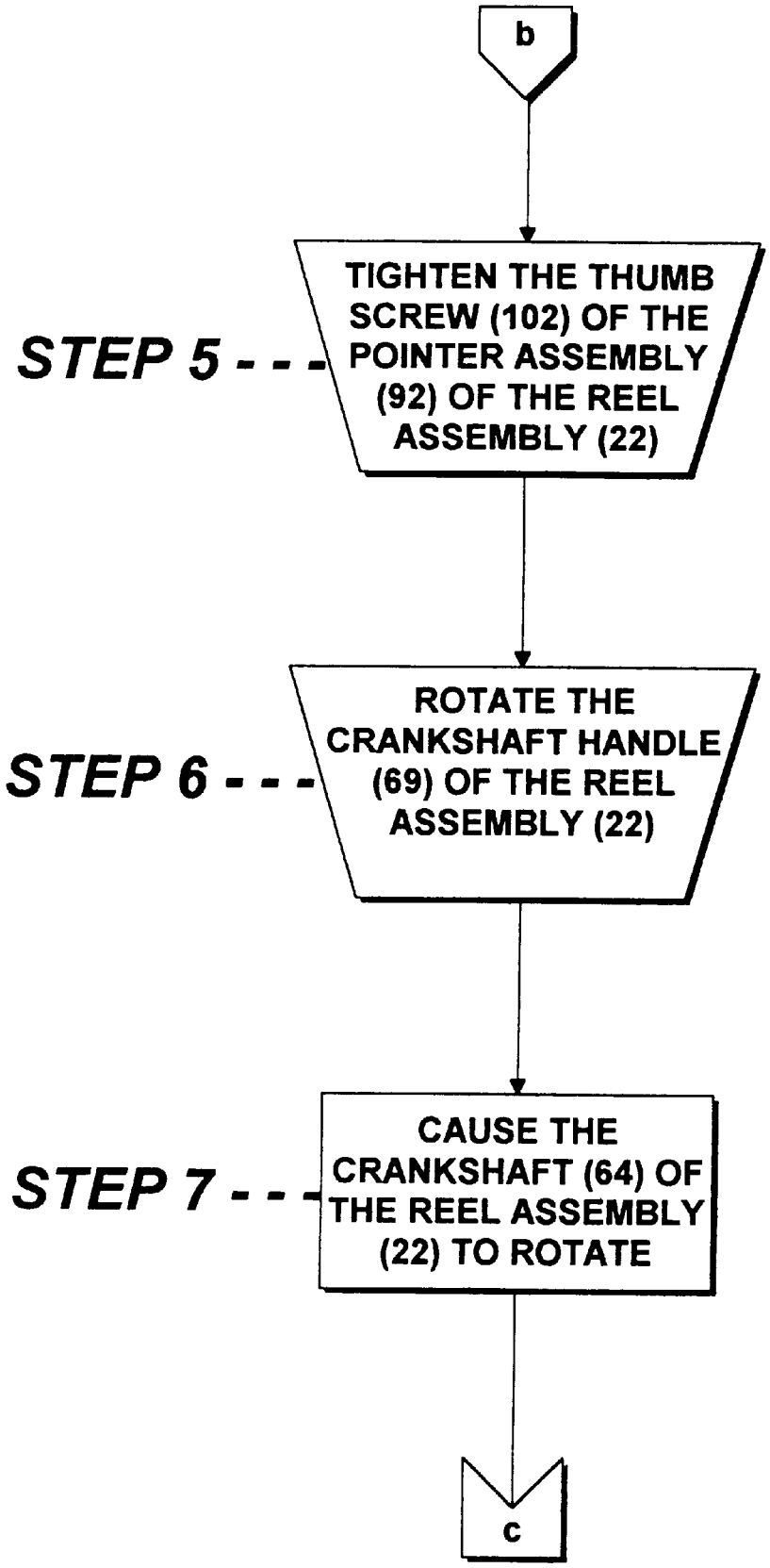
Figure 6D:
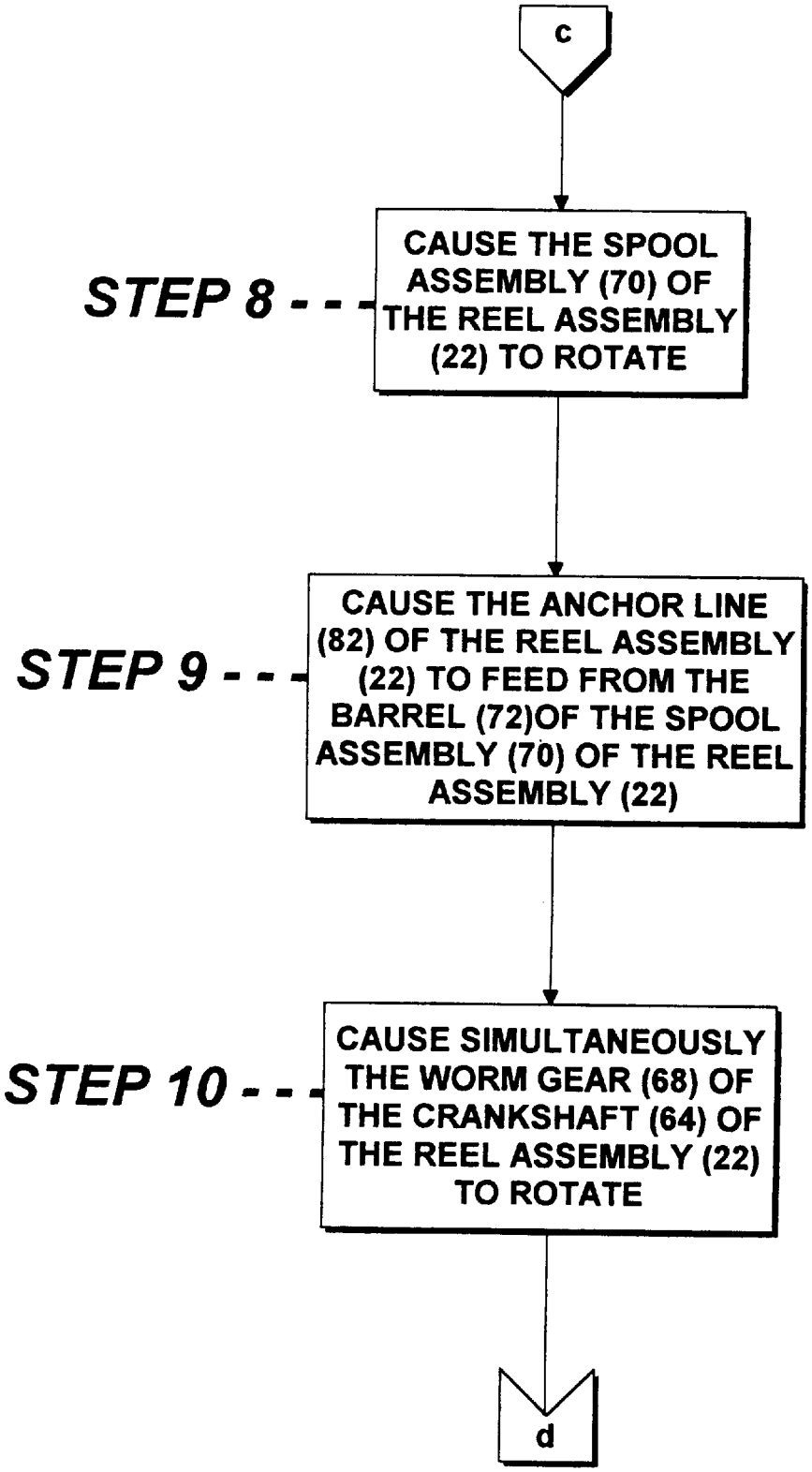
Figure 6E:
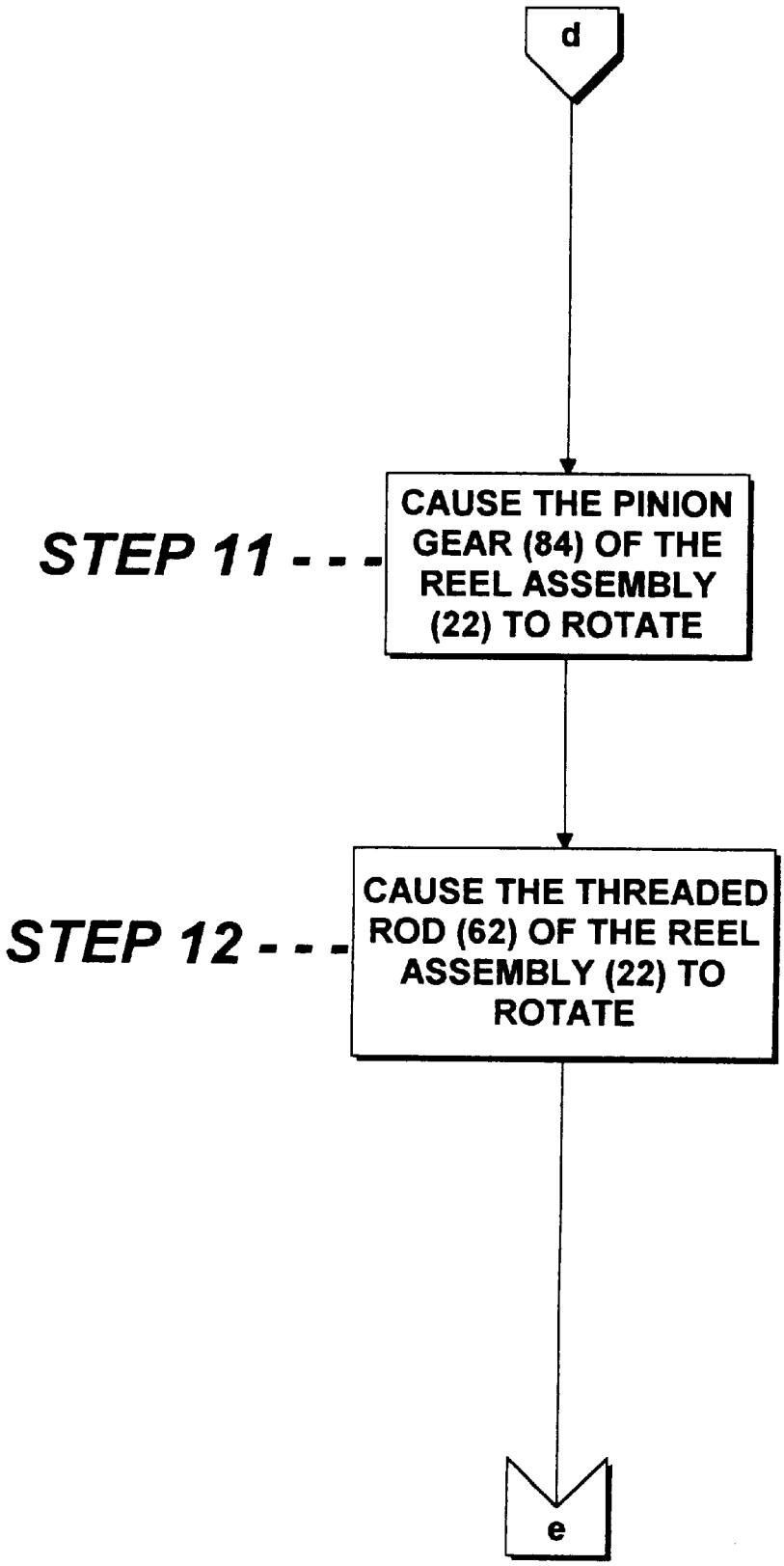
Figure 6F:
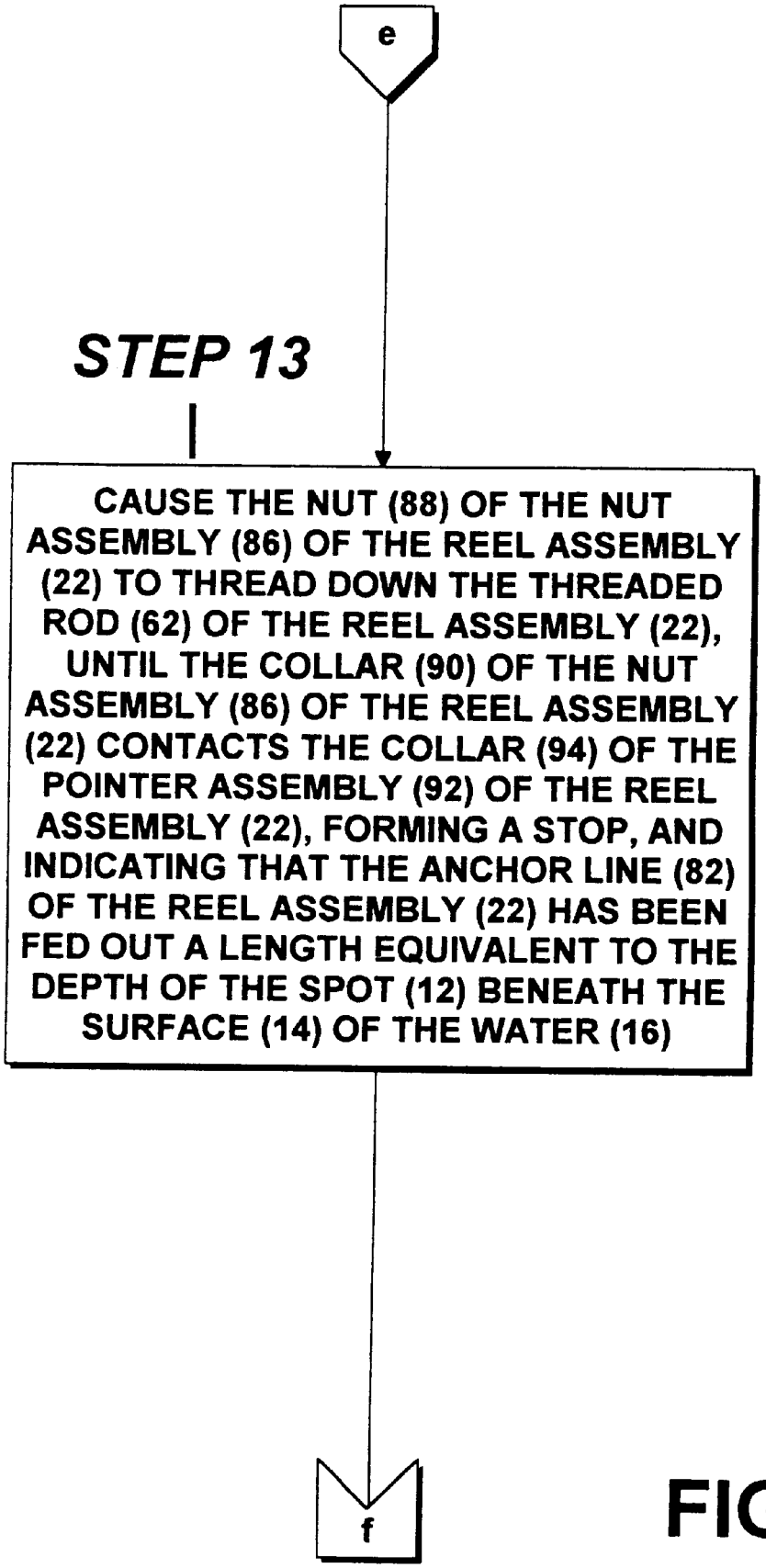
Figure 6G:
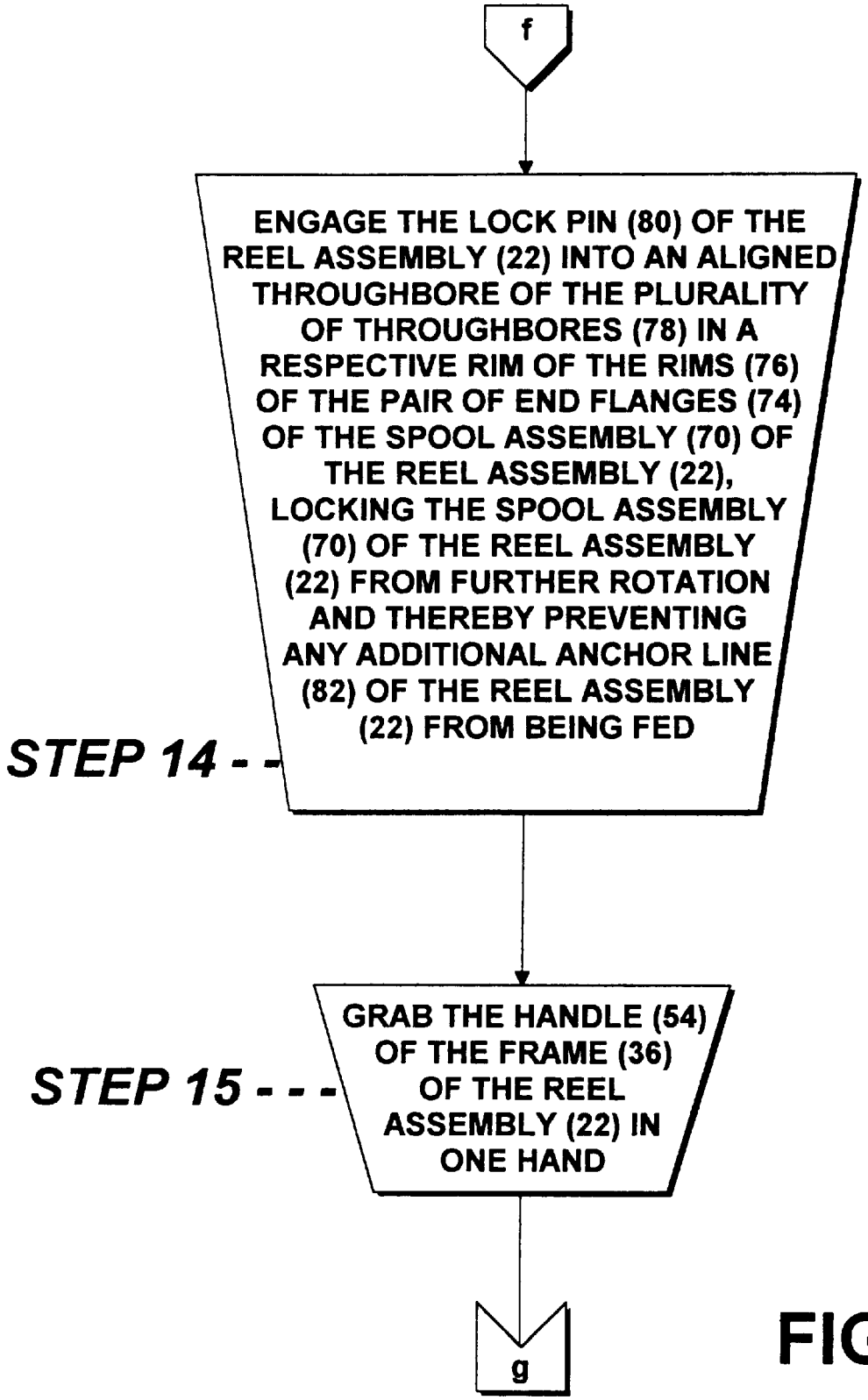
Figure 6H:
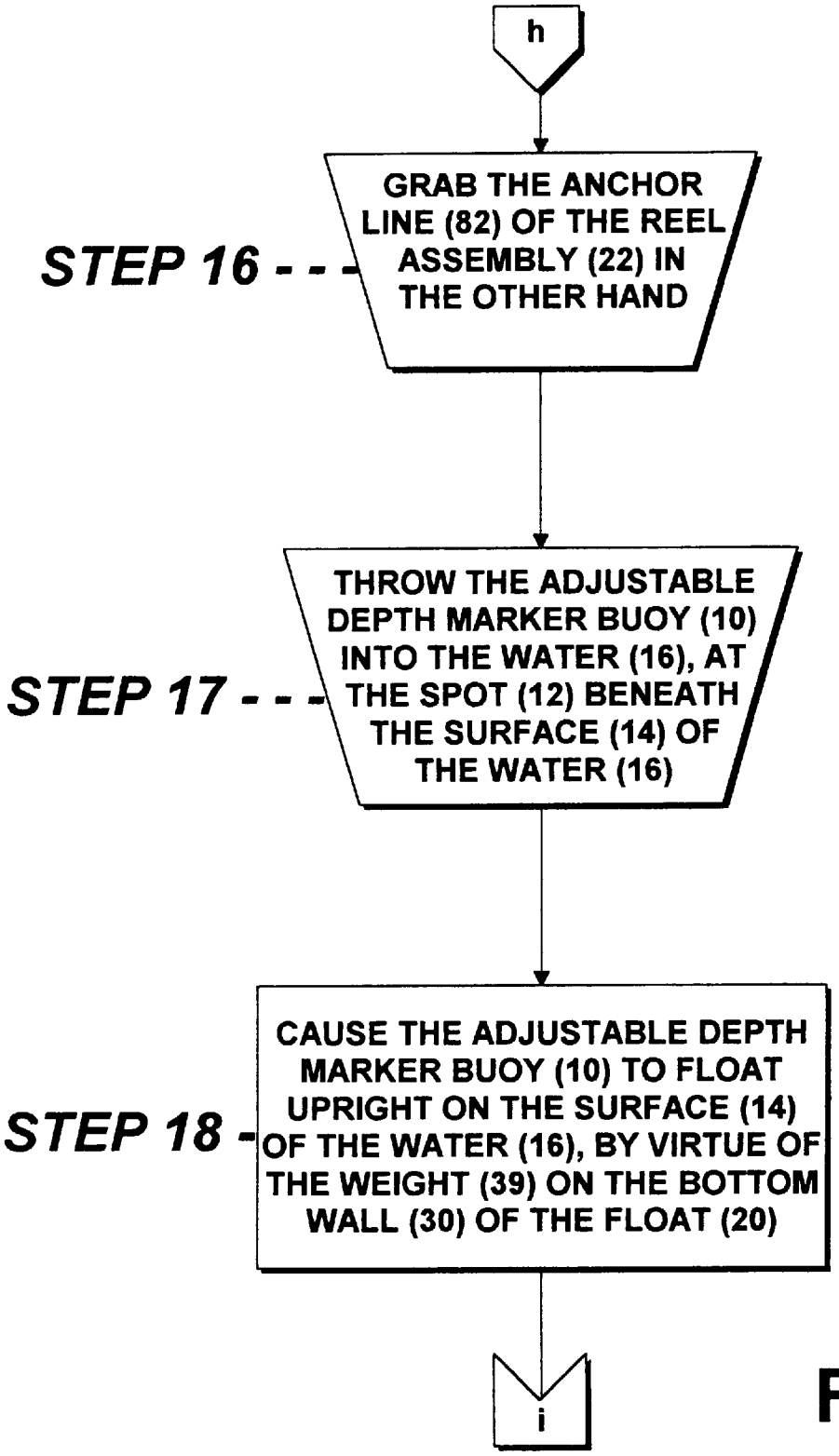
Figure 6I:
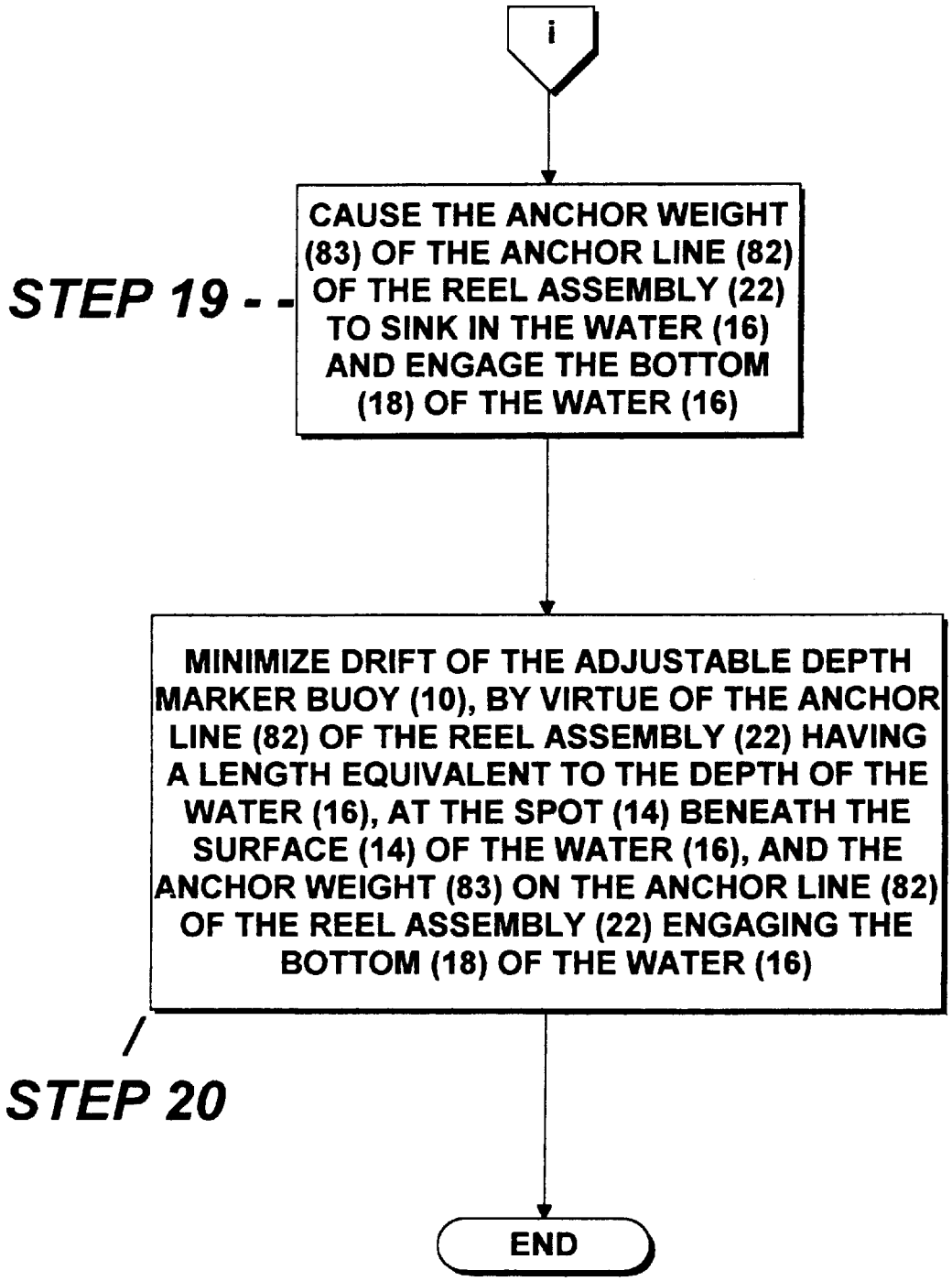

10 adjustable depth marker buoy of the present invention
12 spot beneath surface 14 of water 16
14 surface of water 16
16 water
18 bottom of water 16
20 float for floating on surface 14 of water 16
22 reel assembly
24 front wall of float 20
26 rear wall of float 20
28 top wall of float 20
30 bottom wall of float 20
31 pair of side walls of float 20
32 primary chamber in float 20
33 throughbore in front wall 24 of float 20
34 secondary chamber in float 20
35 throughbore in top wall 28 of float 20
36 frame of reel assembly 22
37 throughbore in bottom wall 30 of float 20
38 pair of side members of frame 36 of reel assembly 22
39 weight on bottom wall 30 of float 20
40 uppermost member of frame 36 of reel assembly 22
41 throughbore in weight 39 on bottom wall 30 of float 20
42 lowermost member of frame 36 of reel assembly 22
43 throughbore in lowermost member 42 of frame 36 of reel assembly 22
44 upper bracket of frame 36 of reel assembly 22
46 lower bracket of frame 36 of reel assembly 22
48 pair of throughbores in upper bracket 44 of frame 36 of reel assembly 22
50 pair of throughbores in lower bracket 44 of frame 36 of reel assembly 22
51 single throughbore in lower bracket 44 of frame 36 of reel assembly 22
52 throughbore in each side member of pair of side members 38 of frame 36 of reel assembly 22
53 throughbore in rear wall 26 of float 20
54 handle of frame 36 of reel assembly 22
55 another throughbore in one side member of pair of side members 38 of frame 36 of reel assembly 22
56 apex of handle 54 of frame 36 of reel assembly 22
58 threaded rod
60 non-threaded rod of reel assembly 22
62 threaded rod of reel assembly 22
64 crankshaft of reel assembly 22
65 initial end of crankshaft 64 of reel assembly 22
66 end of crankshaft 64 of reel assembly 22
68 worm gear of crankshaft 64 of reel assembly 22
69 crankshaft handle of reel assembly 22
70 spool assembly of reel assembly 22
72 barrel of spool assembly 70 of reel assembly 22
74 pair of end flanges of spool assembly 70 of reel assembly 22
76 rims of pair of end flanges 74 of spool assembly 70 of reel assembly 22
78 plurality of throughbores in a rim of rims 76 of pair of end flanges 74 of spool assembly 70 of reel assembly 22 that abuts against one side member of pair of side members 38 of frame 36 of reel assembly 22
80 lock pin of reel assembly 22
82 anchor line of reel assembly 22
83 anchor weight of anchor line 82 of reel assembly 22 for engaging bottom 18 of water 16
84 pinion gear of reel assembly 22
86 nut assembly of reel assembly 22
88 nut of nut assembly 86 of reel assembly 22
90 collar of nut assembly 86 of reel assembly 22
92 pointer assembly of reel assembly 22
94 collar of pointer assembly 92 of reel assembly 22
96 block of pointer assembly 92 of reel assembly 22
98 threaded throughbore in block 96 of pointer assembly 92 of reel assembly 22
100 pointer of pointer assembly 92 of reel assembly 22
102 thumb screw of pointer assembly 92 of reel assembly 22
104 depth plate of pointer assembly 92 of reel assembly 22
106 throughslot in depth plate 104 of pointer assembly 92 of reel assembly 22
108 depth scale indicia on depth plate 104 of pointer assembly 92 of reel assembly 22

DETAILED DESCRIPTION OF THE PREFERRED EMBODIMENT

Referring now to the Figures, in which like numerals indicate like parts, and particularly to FIG. 1, the adjustable depth marker buoy of the present invention is shown generally at 10 for marking a spot 12 beneath the surface 14 of water 16 that has a bottom 18 and a depth.

The configuration of the adjustable marker buoy 10 can best be seen in FIGS. 2–5, and as such will be discussed with reference thereto.

The adjustable marker buoy 10 comprises a float 20 for floating on the surface 14 of the water 16, and a reel assembly 22 disposed in the float 20.

The float 20 is generally frustum-shaped, and has a front wall 24 that is substantially vertically-oriented, a rear wall 26 that is spaced behind the front wall 24 of the float 20 and tapers dependingly, a top wall 28 that is substantially horizontally-oriented and connects the front wall 24 of the float 20 to the rear wall 26 of the float 20, at their uppermost extremes, a bottom wall 30 that is substantially horizontally-oriented, spaced below, and is smaller than, the top wall 28 of the float 20, and connects the front wall 24 of the float 20 to the rear wall 26 of the float 20, at their lowermost extremes, and a pair of side walls 31 that taper dependingly.

The front wall 24 of the float 20, the rear wall 26 of the float 20, the top wall 28 of the float 20, and the bottom wall 30 of the float 20 define axially therebetween a primary chamber 32, which houses a portion of the reel assembly 22, and which extends therefrom laterally in a secondary chamber 34 that opens into the front wall 24 of the float 20 and which houses another portion of the reel assembly 22.

The front wall 24 of the float 20 has a throughbore 33 that extends laterally through, to, and communicates with, the primary chamber 32 in the float 20, slightly above the secondary chamber 34 in the float 20.

The top wall 28 of the float 20 has a throughbore 35 that extends axially therethrough, to, and communicates with, the primary chamber 32 in the float 20, at its top.

The bottom wall 30 of the float 20 has a throughbore 37 that extends axially therethrough to, and communicates with, the primary chamber 32 in the float 20, at its bottom.

The bottom wall 30 of the float 20 further has a weight 39 depending therefrom that maintains an upright orientation for the adjustable depth marker buoy 10 when it is in the water 16, and has a throughbore 41 that extends axially therethrough, in vertical alignment with, and in communication with, the throughbore 37 in the bottom wall 30 of the float 20.

The rear wall 26 of the float 20 has a throughbore 53 that extends laterally therethrough in lateral alignment with, and communicates with, the primary chamber 32 in the float 20.

The reel assembly 22 comprises a frame 36 that is disposed primarily and snugingly in the primary chamber 32 in the float 20.

The frame 36 of the reel assembly 22 comprises a pair side members 38 that are parallel, spaced-apart, slender, elongated, and substantially vertically-oriented, and abut the primary chamber 32 in the float 20, at its axial sides, with one side member of the pair of side members 38 of the frame 36 of the reel assembly 22 communicating with the secondary chamber 34 in the float 20.

The frame 36 of the reel assembly 22 further comprises an uppermost member 40 that is slender and inverted U-shaped, abuts the primary chamber 32 in the float 20, at its top, and connects the pair of side members 38 of the frame 36 of the reel assembly 22 to each other, at their uppermost extremes.

The frame 36 of the reel assembly 22 further comprises a lowermost member 42 that is slender and substantially horizontally-oriented, abuts the primary chamber 32 in the float 20, at its bottom, and connects the pair of side members 38 of the frame 36 of the reel assembly 22 to each other, at their lowermost extremes.

The lowermost member 42 of the frame 36 of the reel assembly 22 has a throughbore 43 that extends axially therethrough.

The frame 36 of the reel assembly 22 further comprises an upper bracket 44 that is slender, and substantially horizontally-oriented, abuts the secondary chamber 34 in the float 20, at its top, and extends laterally from the one side member of the pair of side members 38 of the frame 36 of the reel assembly 22, at its uppermost extreme.

The frame 36 of the reel assembly 22 further comprises a lower bracket 46 that is slender, and substantially horizontally-oriented, abuts the secondary chamber 34 in the float 20, at its bottom, and extends substantially coplanarly laterally from the lowermost member 42 of the frame 36 of the reel assembly 22, parallelaly below the upper bracket 44 of the frame 36 of the reel assembly 22.

The upper bracket 44 of the frame 36 of the reel assembly 22 has a pair of throughbores 48 that are spaced-apart and extend vertically therethrough.

The lower bracket 44 of the frame 36 of the reel assembly 22 has a pair of throughbores 50 that are spaced-apart and extend vertically therethrough, in vertical alignment with the pair of throughbores 48 in the upper bracket 44 of the frame 36 of the reel assembly 22, and a single throughbore 51 that extends vertically therethrough, in axial alignment with, and in communication with, the throughbore 43 in the lowermost member 42 of the frame 36 of the reel assembly 22 and the throughbore 37 in the bottom wall 30 of the float 20.

Each side member of the pair of side members 38 of the frame 36 of the reel assembly 22 has a throughbore 52 that are horizontally aligned with each other, and extend laterally therethrough below, and in proximity of, the upper bracket 44 of the frame 36 of the reel assembly 22, with the throughbore 52 in the other side member of the pair of side members 38 of the frame 36 of the reel assembly 22 in lateral alignment with, and communicating with, the throughbore 53 in the rear wall 26 of the float 20.

The one side member of the pair of side members 38 of the frame 36 of the reel assembly 22 has another throughbore 55 that extends horizontally therethrough, above the upper bracket 44 of the frame 36 of the reel assembly 22, and in alignment with, and communicating with, the throughbore 33 in the front wall 24 of the float 20.

The frame 36 of the reel assembly 22 further comprises a handle 54 that is tubular and inverted triangular-shaped and has an apex 56 from which depends a threaded rod 58 that passes axially through the throughbore 35 in the top wall 28 of the float 20 and threadably engages in the uppermost member 40 of the frame 36 of the reel assembly 22, and provides a way of carrying, and throwing into the water 16, the adjustable depth buoy marker 10.

The reel assembly 22 further comprises a non-threaded rod 60 that depends non-rotatively and axially from an outermost throughbore of the pair of throughbores 48 in the upper bracket 44 of the frame 36 of the reel assembly 20 to non-rotatively an outermost throughbore of the pair of throughbores 50 in the lower bracket 46 of the frame 36 of the reel assembly 20.

The reel assembly 22 further comprises a threaded rod 62 that depends rotatably and axially from an innermost throughbore of the pair of throughbores 48 in the upper bracket 44 of the frame 36 of the reel assembly 20 rotatably to an innermost throughbore of the pair of throughbores 50 in the lower bracket 46 of the frame 36 of the reel assembly 20, and is parallel to the non-threaded rod 60 of the reel assembly 22 and the one side member of the pair of side members 38 of the frame 36 of the reel assembly 20.

The reel assembly 22 further comprises a crankshaft 64 that is laterally-oriented and originates, at its initial end 65, outside the rear wall 26 of the float 20, and extends therefrom rotatably through the throughbore 53 in the rear wall 26 of the float 20, rotatably through the throughbore 52 in each side member of the pair of side members 38 of the frame 36 of the reel assembly 22, and terminates in an end 66 that is past the threaded rod 62 of the reel assembly 22, but before the non-threaded rod 60 of the reel assembly 22, with the end 66 of the crankshaft 64 of the reel assembly 22 being a worm gear 68.

The reel assembly 22 further comprises a crankshaft handle 69 disposed on the initial end 65 of the crankshaft 64 of the reel assembly 22 for rotation therewith.

The reel assembly 22 further comprises a spool assembly 70 that is disposed between the pair of side members 38 of the frame 36 of the reel assembly 22, on the crankshaft 64 of the reel assembly 22 for rotation therewith.

The spool assembly 70 of the reel assembly 22 has a barrel 72 disposed on the crankshaft 64 of the reel assembly 22 for rotation therewith, and a pair of end flanges 74 that abut against the pair of side members 38 of the frame 36 of the reel assembly 22 for rotation relative thereto.

The pair of end flanges 74 of the spool assembly 70 of the reel assembly 22 have rims 76, with a rim thereof that abuts against the one side member of the pair of side members 38 of the frame 36 of the reel assembly 22 having disposed laterally therethrough and circumferentially spaced-therearound, a plurality of throughbores 78, with a respective one thereof alignable with the another throughbore 55 in the one side member of the pair of side members 38 of the frame .36 of the reel assembly 22.

The reel assembly 22 further comprises a lock pin 80 that extends slidingly in the throughbore 33 in the front wall 24 of the float 20, slidingly through the another throughbore 55 in the one side member of the pair of side members 38 of the frame 36 of the reel assembly 22, and selectively engages in an aligned throughbore of the plurality of throughbores 78 in the rim of the rims 76 of the pair of end flanges 74 of the spool assembly 70 of the reel assembly 22, which when engaged locks the spool assembly 70 of the reel assembly 22 against further rotation.

The reel assembly 22 further comprises an anchor line 82 that is wound around the barrel 72 of the spool assembly 70 of the reel assembly 22 and depends through the throughbore 43 in the lowermost member 42 of the frame 36 of the reel assembly 22, through the single throughbore 51 in the lower bracket 44 of the frame 36 of the reel assembly 22, through the throughbore 37 in the bottom wall 30 of the float 20, and through the throughbore 41 in the weight 39, and terminates with an anchor weight 83 for engaging the bottom 18 of the water 16.

The reel assembly 22 further comprises a pinion gear 84 disposed on the threaded rod 62 of the reel assembly 22 for rotation therewith, and which engages the worm gear 68 of the end 66 of the crankshaft 64 of the reel assembly 22, which allows the threaded rod 62 of the reel assembly 22 to rotate when the crankshaft 64 of the reel assembly 22 is rotated.

The reel assembly 22 further comprises a nut assembly 86 which comprises a nut 88 that threadably moves along the threaded rod 62 of the reel assembly 22, below the pinion gear 84 of the reel assembly 22, when the crankshaft 64 of the reel assembly 22 is rotated.

The nut assembly 86 of the reel assembly 22 further comprises a collar 90 that is slidably axially movable along the non-threaded rod 60 of the reel assembly 22, in lateral alignment with, and connected to for movement with, the nut 88 of the nut assembly 86 of the reel assembly 22, which allows the collar 90 of the nut assembly 86 of the reel assembly 22 to slide axially along the non-threaded rod 60 of the reel assembly 22 when the crankshaft 64 of the reel assembly 22 is rotated.

The reel assembly 22 further comprises a pointer assembly 92 that is slidably axially movable along the non-threaded rod 60 of the reel assembly 22, below the collar 90 of the nut assembly 86 of the reel assembly 22.

The pointer assembly 92 of the reel assembly 22 comprises a collar 94 that is slidably axially movable along the non-threaded rod 60 of the reel assembly 22.

The pointer assembly 92 of the reel assembly 22 further comprises a block 96 that extends laterally from the collar 94 of the pointer assembly 92 of the reel assembly 22, and has a threaded throughbore 98 therethrough.

The pointer assembly 92 of the reel assembly 22 further comprises a pointer 100 that extends generally perpendicularly from the block 96 of the pointer assembly 92 of the reel assembly 22, towards a side wall of the pair of side walls 31 of the float 20.

The pointer assembly 92 of the reel assembly 22 further comprises a thumb screw 102 that threadably engages in the threaded throughbore 98 in the block 96 of the pointer assembly 92 of the reel assembly 22, and when tightened, engages the non-threaded rod 60 of the reel assembly 22 preventing further movement of the pointer assembly 92 of the reel assembly 22 therealong.

The pointer assembly 92 of the reel assembly 22 further comprises a depth plate 104 that closes the secondary chamber 34 in the float 20 by extending along the front wall 24 of the float 20.

The depth plate 104 of the pointer assembly 92 of the reel assembly 22 has a throughslot 106 that extends axially therethrough, from the upper bracket 44 of the frame 36 of the reel assembly 22 to the lower bracket 46 of the frame 36 of the reel assembly 22, and which has the pointer 100 of the pointer assembly 92 of the reel assembly 22 passing therethrough.

The depth plate 104 of the pointer assembly 92 of the reel assembly 22 further has depth scale indicia 108 that extends axially along one side of the throughslot 106 in the depth plate 104 of the pointer assembly 92 of the reel assembly 22, and which cooperates with the pointer 100 of the pointer assembly 92 of the reel assembly 22, with the depth scale indicia 108 on the depth plate 104 of the pointer assembly 92 of the reel assembly 22 being so calibrated so as to correspond to the length of the anchor line 82 of the reel assembly 22 being fed.

The method for utilizing the adjustable depth marker buoy 10 can best be seen in FIGS. 6A–6I, and as such will be discussed with reference thereto.

STEP 1: Locate the spot 12 beneath the surface 14 of the water 16.

STEP 2: Determine the depth of the water 16 at the spot 12 beneath the surface 14 of the water 16.

STEP 3: Loosen the thumb screw 102 of the pointer assembly 92 of the reel assembly 22.

STEP 4: Slide the pointer assembly 92 of the reel assembly 22 along the non-threaded rod 60 of the reel assembly 22, until the pointer 100 of the pointer assembly 92 of the reel assembly 22 points to the depth scale indicia 108 on the depth plate 104 of the pointer assembly 92 of the reel assembly 22 corresponding to the depth of the spot 12 beneath the surface 14 of the water 16, previously determined.

STEP 5: Tighten the thumb screw 102 of the pointer assembly 92 of the reel assembly 22.

STEP 6: Rotate the crankshaft handle 69 of the reel assembly 22.

STEP 7: Cause the crankshaft 64 of the reel assembly 22 to rotate.

STEP 8: Cause the spool assembly 70 of the reel assembly 22 to rotate.

STEP 9: Cause the anchor line 82 of the reel assembly 22 to feed from the barrel 72 of the spool assembly 70 of the reel assembly 22.

STEP 10: Cause simultaneously the worm gear 68 of the crankshaft 64 of the reel assembly 22 to rotate.

STEP 11: Cause the pinion gear 84 of the reel assembly 22 to rotate.

STEP 12: Cause the threaded rod 62 of the reel assembly 22 to rotate.

STEP 13: Cause the nut 88 of the nut assembly 86 of the reel assembly 22 to thread down the threaded rod 62 of the reel assembly 22, until the collar 90 of the nut assembly 86 of the reel assembly 22 contacts the collar 94 of the pointer assembly 92 of the reel assembly 22, forming a stop, and indicating that the anchor line 82 of the reel assembly 22 has been fed out a length equivalent to the depth of the spot 12 beneath the surface 14 of the water 16.

STEP 14: Engage the lock pin 80 of the reel assembly 22 into an aligned throughbore of the plurality of throughbores 78 in a respective rim of the rims 76 of the pair of end flanges 74 of the spool assembly 70 of the reel assembly 22, locking the spool assembly 70 of the reel assembly 22 from further rotation and thereby preventing any additional anchor line 82 of the reel assembly 22 from being fed.

STEP 15: Grab the handle 54 of the frame 36 of the reel assembly 22 in one hand.

STEP 16: Grab the anchor line 82 of the reel assembly 22 in the other hand.

STEP 17: Throw the adjustable depth marker buoy 10 into the water 16, at the spot 12 beneath the surface 14 of the water 16.

STEP 18: Cause the adjustable depth marker buoy 10 to float upright on the surface 14 of the water 16, by virtue of the weight 39 on the bottom wall 30 of the float 20.

STEP 19: Cause the anchor weight 83 of the anchor line 82 of the reel assembly 22 to sink in the water 16 and engage the bottom 18 of the water 16.

STEP 20: Minimize drift of the adjustable depth marker buoy 10, by virtue of the anchor line 82 of the reel assembly 22 having a length equivalent to the depth of the water 16, at the spot 14 beneath the surface 14 of the water 16, and the anchor weight 83 on the anchor line 82 of the reel assembly 22 engaging the bottom 18 of the water 16.

It will be understood that each of the elements described above, or two or more together, may also find a useful application in other types of constructions differing from the types described above.

While the invention has been illustrated and described as embodied in an adjustable depth marker buoy, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. An adjustable depth marker buoy for marking a spot beneath the surface of water that has a bottom and a depth, said buoy comprising:

a) a float for floating on the surface of the water; and b) a reel assembly disposed in said float, wherein said float is generally frustum-shaped, and has:

i) a front wall that is substantially vertically-oriented;

ii) a rear wall that is spaced behind said front wall of said float and tapers dependingly;

iii) a top wall that is substantially horizontally-oriented and connects said front wall of said float to said rear wall of said float, at their uppermost extremes;

iv) a bottom wall that is substantially horizontally-oriented, spaced below, and is smaller than, said top wall of said float, and connects said front wall of said float to said rear wall of said float, at their lowermost extremes; and v) a pair of side walls that taper dependingly, wherein said front wall of said float, said rear wall of said float, said top wall of said float, and said bottom wall of said float define axially therebetween a primary chamber which houses a portion of said reel assembly, and which extends therefrom laterally in a secondary chamber that opens into said front wall of said float and which houses another portion of said reel assembly.

2. The buoy as defined in claim 1, wherein said front wall of said float has a throughbore that extends laterally therethrough to, and communicates with, said primary chamber in said float, slightly above said secondary chamber in said float.

3. The buoy as defined in claim 2, wherein said top wall of said float has a throughbore that extends axially therethrough to, and communicates with, said primary chamber in said float, at its top.

4. The buoy as defined in claim 3, wherein said bottom wall of said float has a throughbore that extends axially therethrough to, and communicates with, said primary chamber in said float, at its bottom.

5. The buoy as defined in claim 4, wherein said bottom wall of said float further has a weight depending therefrom that maintains an upright orientation for said adjustable depth marker buoy when it is in the water, and has a throughbore that extends axially therethrough, in vertical alignment with, and in communication with, said throughbore in said bottom wall of said float.

6. The buoy as defined in claim 4, wherein said rear wall of said float has a throughbore that extends laterally therethrough in lateral alignment with, and communicates with, said primary chamber in said float.

7. The buoy as defined in claim 6, wherein said reel assembly comprises a frame that is disposed primarily and snugingly in said primary chamber in said float.

8. The buoy as defined in claimed 7, wherein said frame of said reel assembly comprises a pair of side members that are parallel, spaced-apart, slender, elongated, and substantially vertically-oriented, and abut said primary chamber in said float, at its axial sides, with one side member of said pair of side members of said frame of said reel assembly communicating with said secondary chamber in said float.

9. The buoy as defined in claim 8, wherein said frame of said reel assembly further comprises an uppermost member that is slender and inverted U-shaped, abuts said primary chamber in said float, at its top, and connects said pair of side members of said frame of said reel assembly to each other, at their uppermost extremes.

10. The buoy as defined in claim 9, wherein said frame of said reel assembly further comprises a lowermost member that is slender and substantially horizontally-oriented, abuts said primary chamber in said float, at its bottom, and connects said pair of side members of said frame of said reel assembly to each other, at their lowermost extremes.

11. The buoy as defined in claim 10, wherein said lowermost member of said frame of said reel assembly has a throughbore that extends axially therethrough.

12. The buoy as defined in claim 11, wherein said frame of said reel assembly further comprises an upper bracket that is slender, and substantially horizontally-oriented, abuts said secondary chamber in said float, at its top, and extends laterally from said one side member of said pair of side members of said frame of said reel assembly, at its uppermost extreme.

13. The buoy as defined in claim 12, wherein said frame of said reel assembly further comprises a handle that is tubular and inverted triangular-shaped and has an apex from which depends a threaded rod that passes axially through said throughbore in said top wall of said float and threadably engages in said uppermost member of said frame of said reel assembly, and provides a way of carrying, and throwing into the water, said adjustable depth buoy marker.

14. The buoy as defined in claim 12, wherein said frame of said reel assembly further comprises a lower bracket that is slender, and substantially horizontally-oriented, abuts said secondary chamber in said float, at its bottom, and extends substantially coplanarly laterally from said lowermost member of said frame of said reel assembly, parallelaly below said upper bracket of said frame of said reel assembly.

15. The buoy as defined in claim 14, wherein said upper bracket of said frame of said reel assembly has a pair of throughbores that are spaced-apart and extend vertically therethrough.

16. The buoy as defined in claim 15, wherein said lower bracket of said frame of said reel assembly has a pair of throughbores that are spaced-apart and extend vertically therethrough, in vertical alignment with said pair of throughbores in said upper bracket of said frame of said reel assembly, and a single throughbore that extends vertically therethrough, in axial alignment with, and in communication with, said throughbore in said lowermost member of said frame of said reel assembly and said throughbore in said bottom wall of said float.

17. The buoy as defined in claim 16, wherein each side member of said pair of side members of said frame of said reel assembly has a throughbore that are horizontally aligned with each other, and extend laterally therethrough below, and in proximity of, said upper bracket of said frame of said reel assembly, with said throughbore in the other side member of said pair of side members of said frame of said reel assembly in lateral alignment with, and communicating with, said throughbore in said rear wall of said float.

18. The buoy as defined in claim 17, wherein said one side member of said pair of side members of said frame of said reel assembly has another throughbore that extends horizontally therethrough, above said upper bracket of said frame of said reel assembly, and in alignment with, and communicating with, said throughbore in said front wall of said float.

19. The buoy as defined in claim 18, wherein said reel assembly further comprises a non-threaded rod that depends non-rotatively and axially from an outermost throughbore of said pair of throughbores in said upper bracket of said frame of said reel assembly to non-rotatively an outermost throughbore of said pair of throughbores in said lower bracket of said frame of said reel assembly.

20. The buoy as defined in claim 19, wherein said reel assembly further comprises a threaded rod that depends rotatably and axially from an innermost throughbore of said pair of throughbores in said upper bracket of said frame of said reel assembly rotatably to an innermost throughbore of said pair of throughbores in said lower bracket of said frame of said reel assembly, and is parallel to said non-threaded rod of said reel assembly and said one side member of said pair of side members of said frame of said reel assembly.

21. The buoy as defined in claim 20, wherein said reel assembly further comprises a crankshaft that is laterally-oriented and originates, at its initial end, outside said rear wall of said float, and extends therefrom rotatably through said throughbore in said rear wall of said float, rotatably through said throughbore in each side member of said pair of side members of said frame of said reel assembly, and terminates in an end that is past said threaded rod of said reel assembly, but before said non-threaded rod of said reel assembly, with said end of said crankshaft of said reel assembly being a worm gear.

22. The buoy as defined in claim 21, wherein said reel assembly further comprises a crankshaft handle disposed on said initial end of said crankshaft of said reel assembly for rotation therewith.

23. The buoy as defined in claim 21, wherein said reel assembly further comprises a spool assembly that is disposed between said pair of side members of said frame of said reel assembly, on said crankshaft of said reel assembly for rotation therewith.

24. The buoy as defined in claim 23, wherein said spool assembly of said reel assembly has a barrel disposed on said crankshaft of said reel assembly for rotation therewith, and a pair of end flanges that abut against said pair of side members of said frame of said reel assembly for rotation relative thereto.

25. The buoy as defined in claim 24, wherein said pair of end flanges of said spool assembly of said reel assembly have rims, with a rim thereof that abuts against said one side member of said pair of side members of said frame of said reel assembly having disposed laterally therethrough and circumferentially spaced-therearound, a plurality of throughbores, with a respective one thereof alignable with said another throughbore in said one side member of said pair of side members of said frame of said reel assembly.

26. The buoy as defined in claim 25, wherein said reel assembly further comprises a lock pin that extends slidingly in said throughbore in said front wall of said float, slidingly through said another throughbore in said one side member of said pair of side members of said frame of said reel assembly, and selectively engages in an aligned throughbore of said plurality of throughbores in said rim of said rims of said pair of end flanges of said spool assembly of said reel assembly, which when engaged locks said spool assembly of said reel assembly against further rotation.

27. The buoy as defined in claim 24, wherein said reel assembly further comprises an anchor line that has a length and is wound around said barrel of said spool assembly of said reel assembly and depends through said throughbore in said lowermost member of said frame of said reel assembly, through said single throughbore in said lower bracket of said frame of said reel assembly, through said throughbore in said bottom wall of said float, and through said throughbore in said weight, and terminates with an anchor weight for engaging the bottom of the water.

28. The buoy as defined in claim 27, wherein said reel assembly further comprises a pinion gear disposed on said threaded rod of said reel assembly for rotation therewith, and which engages said worm gear of said end of said crankshaft of said reel assembly, which allows said threaded rod of said reel assembly to rotate when said crankshaft of said reel assembly is rotated.

29. The buoy as defined in claim 28, wherein said reel assembly further comprises a nut assembly which comprises a nut that threadably moves along said threaded rod of said reel assembly, below said pinion gear of said reel assembly, when said crankshaft of said reel assembly is rotated.

30. The buoy as defined in claim 29, wherein said nut assembly of said reel assembly further comprises a collar that is slidably axially movable along said non-threaded rod of said reel assembly, in lateral alignment with, and connected to for movement with, said! nut of said nut assembly of said reel assembly, which allows said collar of said nut assembly of said reel assembly to slide axially along said non-threaded rod of said reel assembly when said crankshaft of said reel assembly is rotated.

31. The buoy as defined in claim 30, wherein said reel assembly further comprises a pointer assembly that is slidably axially movable along said non-threaded rod of said reel assembly, below said collar of said nut assembly of said reel assembly.

32. The buoy as defined in claim 31, wherein said pointer assembly of said reel assembly comprises a collar that is slidably axially movable along said non-threaded rod of said reel assembly.

33. The buoy as defined in claim 32, wherein said pointer assembly of said reel assembly further comprises a block that extends laterally from said collar of said pointer assembly of said reel assembly, and has a threaded throughbore therethrough.

34. The buoy as defined in claim 33, wherein said pointer assembly of said reel assembly further comprises a thumb screw that threadably engages in said threaded throughbore in said block of said pointer assembly of said reel assembly, and when tightened, engages said non-threaded rod of said reel assembly preventing further movement of said pointer assembly of said reel assembly therealong.

35. The buoy as defined in claim 33, wherein said pointer assembly of said reel assembly further comprises a pointer that extends generally perpendicularly from said block of said pointer assembly of said reel assembly, towards a side wall of said pair of side walls of said float.

36. The buoy as defined in claim 35, wherein said pointer assembly of said reel assembly further comprises a depth plate that closes said secondary chamber in said float by extending along said front wall of said float.

37. The buoy as defined in claim 36, wherein said depth plate of said pointer assembly of said reel assembly has a throughslot that extends axially therethrough, from said upper bracket of said frame of said reel assembly to said lower bracket of said frame of said reel assembly, and which has said pointer of said pointer assembly of said reel assembly passing therethrough.

38. The buoy as defined in claim 37, wherein said depth plate of said pointer assembly of said reel assembly further has depth scale indicia that extends axially along one side of said throughslot in said depth plate of said pointer assembly of said reel assembly, and which cooperates with said pointer of said pointer assembly of said reel assembly, with said depth scale indicia on said depth plate of said pointer assembly of said reel assembly being so calibrated so as to correspond to said length of said anchor line of said reel assembly being fed.

39. A method for utilizing an adjustable depth marker buoy for marking a spot beneath the surface of water that has a bottom and a depth, said method comprising the steps of:

a) locating the spot beneath the surface of the water;

b) determining the depth of the water at the spot beneath the surface of the water;

c) loosening a thumb screw of a pointer assembly of a reel assembly of said adjustable depth marker buoy;

d) sliding said pointer assembly of said reel assembly along a non-threaded rod of said reel assembly, until a pointer of said pointer assembly of said reel assembly points to depth scale indicia on a depth plate of said pointer assembly of said reel assembly corresponding to the depth of the spot beneath the surface of the water, previously determined;

e) tightening said thumb screw of said pointer assembly of said reel assembly;

f) rotating a crankshaft handle of said reel assembly;

g) causing a crankshaft of said reel assembly to rotate;

h) causing a spool assembly of said reel assembly to rotate;

i) causing an anchor line of said reel assembly to feed from a barrel of said spool assembly of said reel assembly;

j) causing simultaneously a worm gear on said crankshaft of said reel assembly to rotate;

k) causing a pinion gear of said reel assembly to rotate;

l) causing a threaded rod of said reel assembly to rotate;

m) causing a nut of a nut assembly of said reel assembly to thread down said threaded rod of said reel assembly, until a collar of said nut assembly of said reel assembly contacts a collar of said pointer assembly of said reel assembly, forming a stop, and indicating that said anchor line of said reel assembly has been fed out a length equivalent to the depth of the spot beneath the surface of the water;

n) engaging a lock pin of said reel assembly into an aligned throughbore of a plurality of throughbores in a respective rim of rims of a pair of end flanges of said spool assembly of said reel assembly, locking said spool assembly of said reel assembly from further rotation and thereby preventing any additional anchor line of said reel assembly from being fed;

o) grabbing a handle of a frame of said reel assembly in one hand;

p) grabbing said anchor line of said reel assembly in the other hand;

q) throwing said adjustable depth marker buoy into the water, at the spot beneath the surface of the water;

r) causing said adjustable depth marker buoy to float upright on the surface of the water, by virtue of a weight on a bottom wall of a float of said adjustable depth marker buoy;

s) causing an anchor weight on said anchor line of said reel assembly to sink in the water and engage the bottom of the water; and t) minimizing drift of said adjustable depth marker buoy, by virtue of said anchor line of said reel assembly having a length equivalent to the depth of the water, at the spot beneath the surface of the water, and said anchor weight on said anchor line of said reel assembly engaging the bottom of the water.

* * * * *